US008291948B1

(12) United States Patent
Marks

(10) Patent No.: US 8,291,948 B1
(45) Date of Patent: Oct. 23, 2012

(54) CENTERING GUIDE FOR AUTOMATED BOTTLING MACHINERY

(76) Inventor: George H. Marks, Cumming, GA (US)

( * ) Notice: Subject to any disclaimer, the term of this patent is extended or adjusted under 35 U.S.C. 154(b) by 0 days.

(21) Appl. No.: 13/423,099

(22) Filed: Mar. 16, 2012

(51) Int. Cl.
*B65B 1/04* (2006.01)

(52) U.S. Cl. ..... 141/372; 141/369; 141/370; 141/371

(58) Field of Classification Search ..... 141/141–147, 141/369–372
See application file for complete search history.

(56) References Cited

U.S. PATENT DOCUMENTS

| | | | | |
|---|---|---|---|---|
| 3,037,536 | A * | 6/1962 | Fechheimer et al. | 141/7 |
| 3,580,302 | A * | 5/1971 | Riesenberg | 141/141 |
| 3,742,989 | A | 7/1973 | Campbell et al. | |
| 3,776,285 | A * | 12/1973 | Nicholls | 141/386 |
| 4,014,372 | A * | 3/1977 | Dichiara | 141/392 |
| 4,100,948 | A | 7/1978 | Abramoska, Jr. | |
| 4,335,761 | A | 6/1982 | Peronek | |
| 4,616,684 | A * | 10/1986 | Tincati | 141/114 |
| 5,082,033 | A | 1/1992 | Weiss | |
| 5,295,517 | A * | 3/1994 | Ahlers | 141/1 |
| 5,301,725 | A * | 4/1994 | Meinzinger | 141/372 |
| 5,533,552 | A * | 7/1996 | Ahlers | 141/144 |
| 6,038,833 | A * | 3/2000 | Beringer | 53/253 |
| 6,135,167 | A | 10/2000 | Kiholm | |
| 7,311,125 | B2 * | 12/2007 | Krulitsch | 141/149 |
| 7,331,156 | B2 | 2/2008 | Hartness et al. | |
| 7,753,096 | B2 | 7/2010 | Poeschl et al. | |
| 2009/0101231 | A1 | 4/2009 | Poeschl et al. | |
| 2011/0023996 | A1 | 2/2011 | Laumer et al. | |

OTHER PUBLICATIONS

Website, www.marksmachinery.com/products/centering-guides/krones-centering-guides/krones-oentering-guides/ Krones Centering Guides, one sheet printed from the Internet on Nov. 21, 2011.

* cited by examiner

*Primary Examiner* — Timothy L Maust
(74) *Attorney, Agent, or Firm* — Richard C. Litman

(57) ABSTRACT

The centering guide for automated bottling machinery is secured to its filler unit by a central saddle. Two laterally opposed posts slide in holes through the saddle. A bridge extends across the upper ends of the posts. The bridge provides attachment for a cam roller traveling on a cam as the bottling unit and guide rotate with its filler unit. The lower ends of the posts are threaded into a base plate holding a single piece guide bell removably therein. The bell has a resilient seal removably installed therein. As the cam roller is reciprocated by the stationary cam during rotation of the bottling unit, the bridge, posts, and base are also actuated to raise and lower the guide bell over the bottle mouth in concert with the filling operation. Springs are installed between saddle and base plate to assure proper operation when the bell is lowered.

20 Claims, 5 Drawing Sheets

CENTERING GUIDE FOR AUTOMATED BOTTLING MACHINERY

BACKGROUND OF THE INVENTION

1. Field of the Invention

The present invention relates to automated manufacturing and processing machinery and equipment, and particularly to a centering guide for automated bottling machinery that aligns the mouth of a bottle with the filler spout during bottling operations.

2. Description of the Related Art

The bottling industry makes use of highly complex machinery employing various mechanical, electrical, pneumatic, and hydraulic principles of operation in order to provide rapid filling and processing of bottles during bottling operations. Such machinery achieves the economy of scale necessary to provide a product at the lowest possible price. The machinery is used in the bottling of beer, soft drinks, and numerous other liquids.

Such equipment may be subdivided into a number of different sub-components or subassemblies. Among these is the centering guide, which automatically centers and holds the mouth of a bottle beneath the filler spout prior to the spout being lowered into the mouth and neck of the bottle in order to fill the bottle. A number of different centering guide configurations have been developed in the past, according to the specific bottling machinery in which the centering guide is to be installed.

Many of these earlier centering guides have various problems that result in relatively frequent down time for the bottling machine and require significant time for repair or replacement.

Thus, a centering guide for automated bottling machinery solving the aforementioned problems is desired.

SUMMARY OF THE INVENTION

The centering guide for automated bottling machinery aligns the mouth of a bottle with the filler spout during bottling operations. While the present centering guide is adapted particularly for installation with Krones bottling machinery, many of its features may be adapted for installation and use with other types of bottling machinery.

The centering guide is attached to its filler unit and rotates with the filler unit during bottling operations. The centering guide includes a central saddle component that is bolted to its accompanying filler unit. The saddle has two laterally opposed vertical passages for corresponding posts that travel up and down in the saddle. The upper ends of the posts are connected to one another by a bridge. The bridge has a cam roller extending therefrom. The cam roller rides along a stationary cam as the filler assembly rotates with its centering guide, and causes the roller, the bridge, and the posts to move up and down according to the height of the cam.

The two lower ends of the posts are connected to one another by a base plate that also holds a single piece centering bell removably therein. The centering bell, in turn, holds a replaceable resilient seal therein. The base plate, the centering bell, and the seal are lifted and lowered according to the travel of the cam roller wheel along the cam in order to lower the bell and its seal onto the mouth of a bottle for assuring the alignment of the bottle with the filler mechanism during bottling operations. The plate, the bell, and the seal are lifted from the bottle when the filling operation has been completed as the bridge, posts, and base are lifted by the cam.

The centering bell is a single piece component having the resilient seal frictionally gripped therein, enabling a worn or damaged seal to be replaced merely by pressing out the old seal by hand and pressing in a new seal. No disassembly of the bell is required. The posts include springs thereon between the saddle and the base plate, the springs providing bias force that adds to the weight of the base plate, posts, and bridge to drive the base plate and its centering bell down as the roller descends along its path on the cam. The posts are threaded into the base plate, providing a relatively rigid and sturdy assembly. The cam roller is secured by a bolt to a spacer or axle extending from the bridge, resulting in a very secure attachment for the roller that also allows the roller to be replaced quickly and easily when the need arises. The centering guide is reliable, requires less down time for repair, and is more economical to repair when required.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The centering guide for automated bottling machinery aligns the mouth of a bottle with the filler spout during bottling operations. The centering guide is reliable, requires less down time for repair, and is more economical to repair when required.

Figure 1:
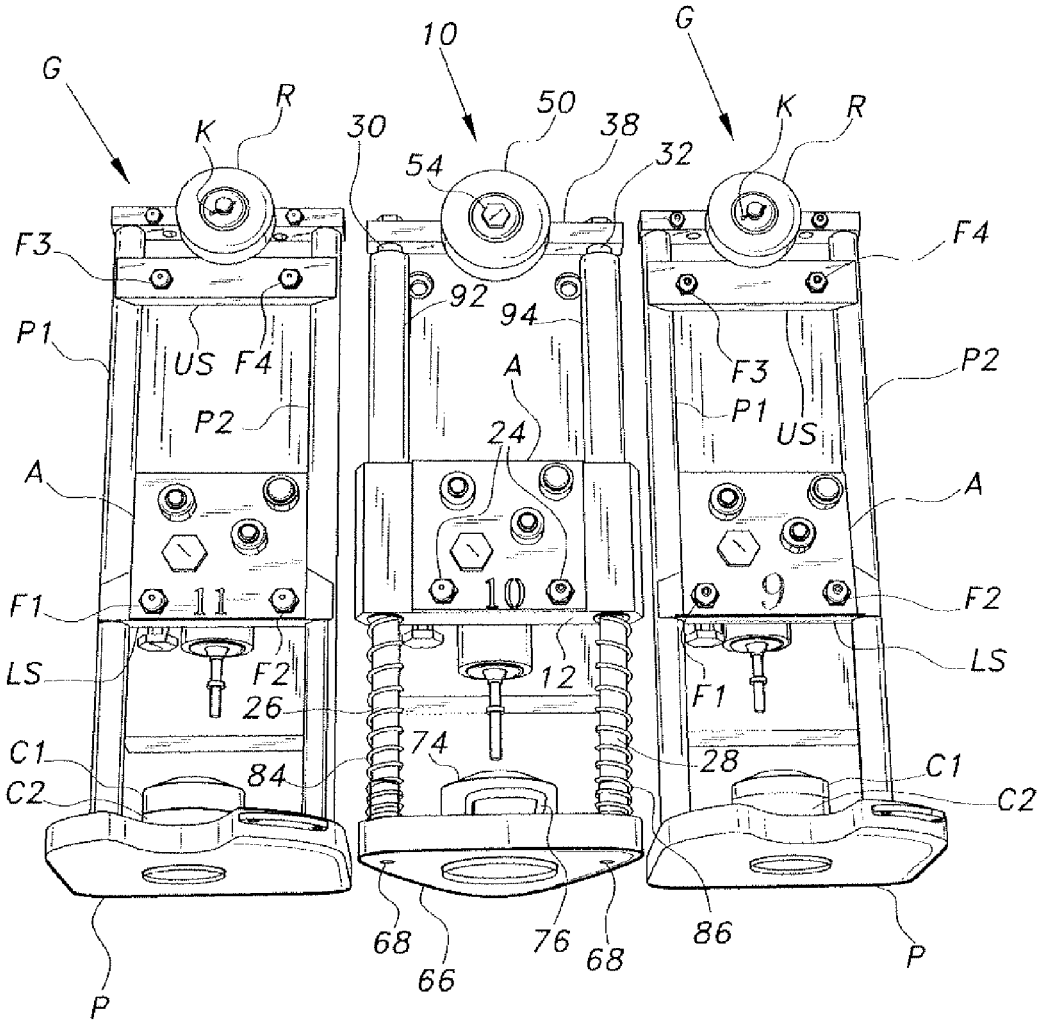
FIG. 1 is an environmental, perspective view of a bottling machinery line having a centering guide for automated bottling machinery according to the present invention shown between two identical centering guides of the prior art.

FIG. 1 of the drawings provides a comparison of the present centering guide 10 to centering guides G developed for operation with Krones manufactured bottling machinery. The centering guides are normally installed on a rotary platform. The installation of a continuous series of prior art centering guides G is conventional in the automated bottling industry. FIG. 1 shows such a conventional installation, with the exception of the present centering guide 10 installed between two conventional centering guides.

Figure 2:
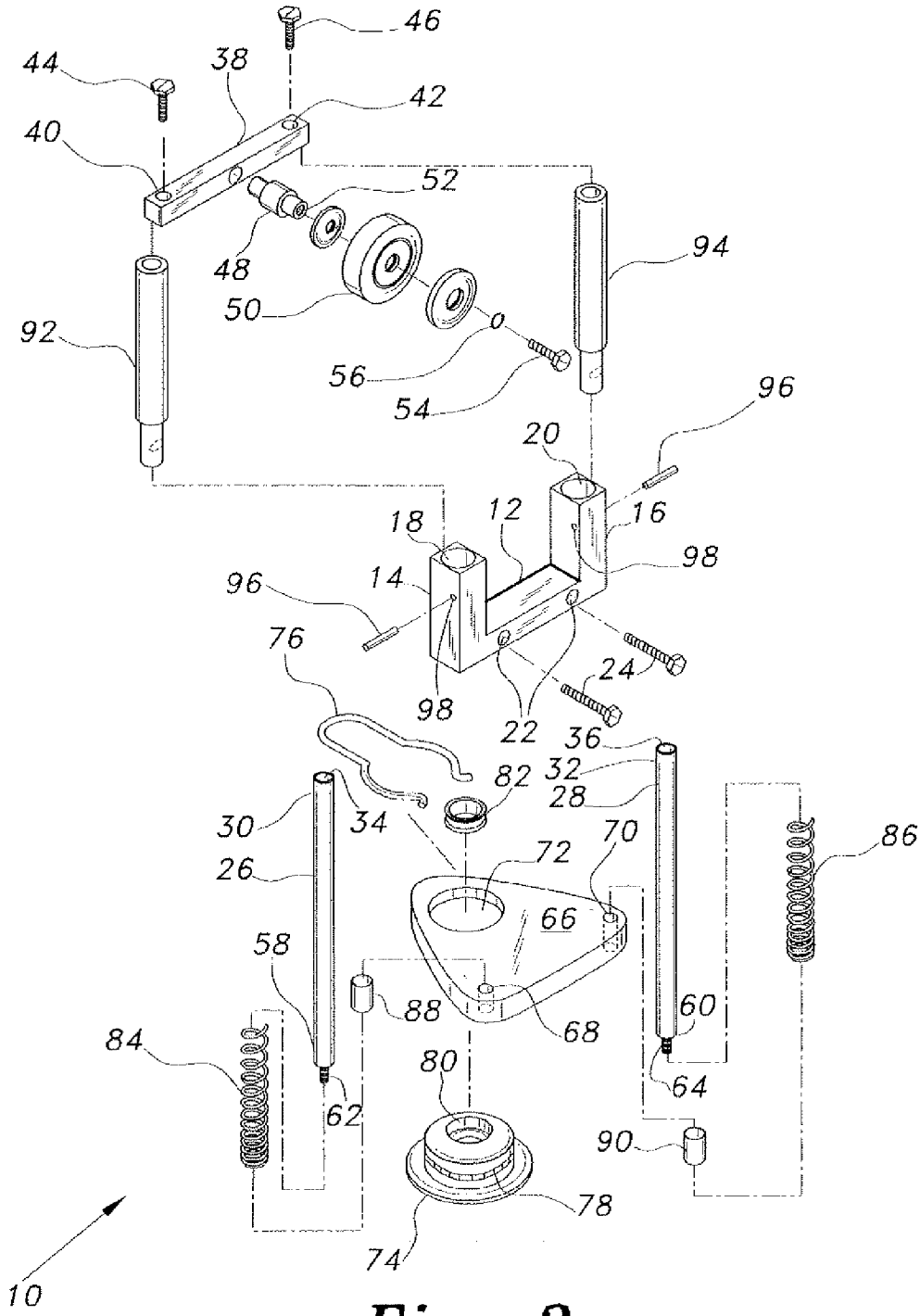
FIG. 2 is an exploded perspective view of a centering guide for automated bottling machinery according to the present invention, illustrating its various components and their mutual relationships.
Figure 3:
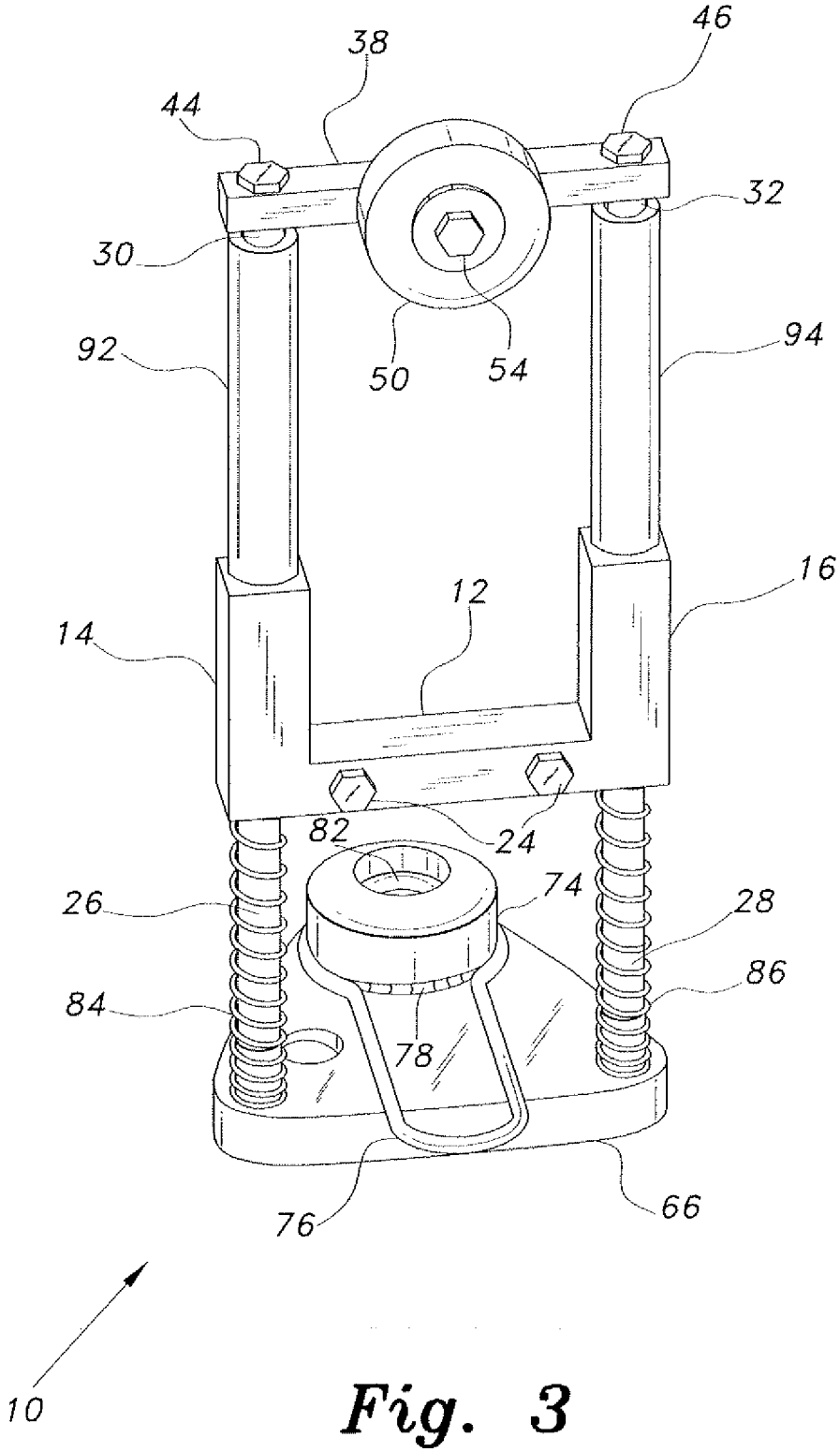
FIG. 3 is a front perspective view of a centering guide for automated bottling machinery according to the present invention.
Figure 4:
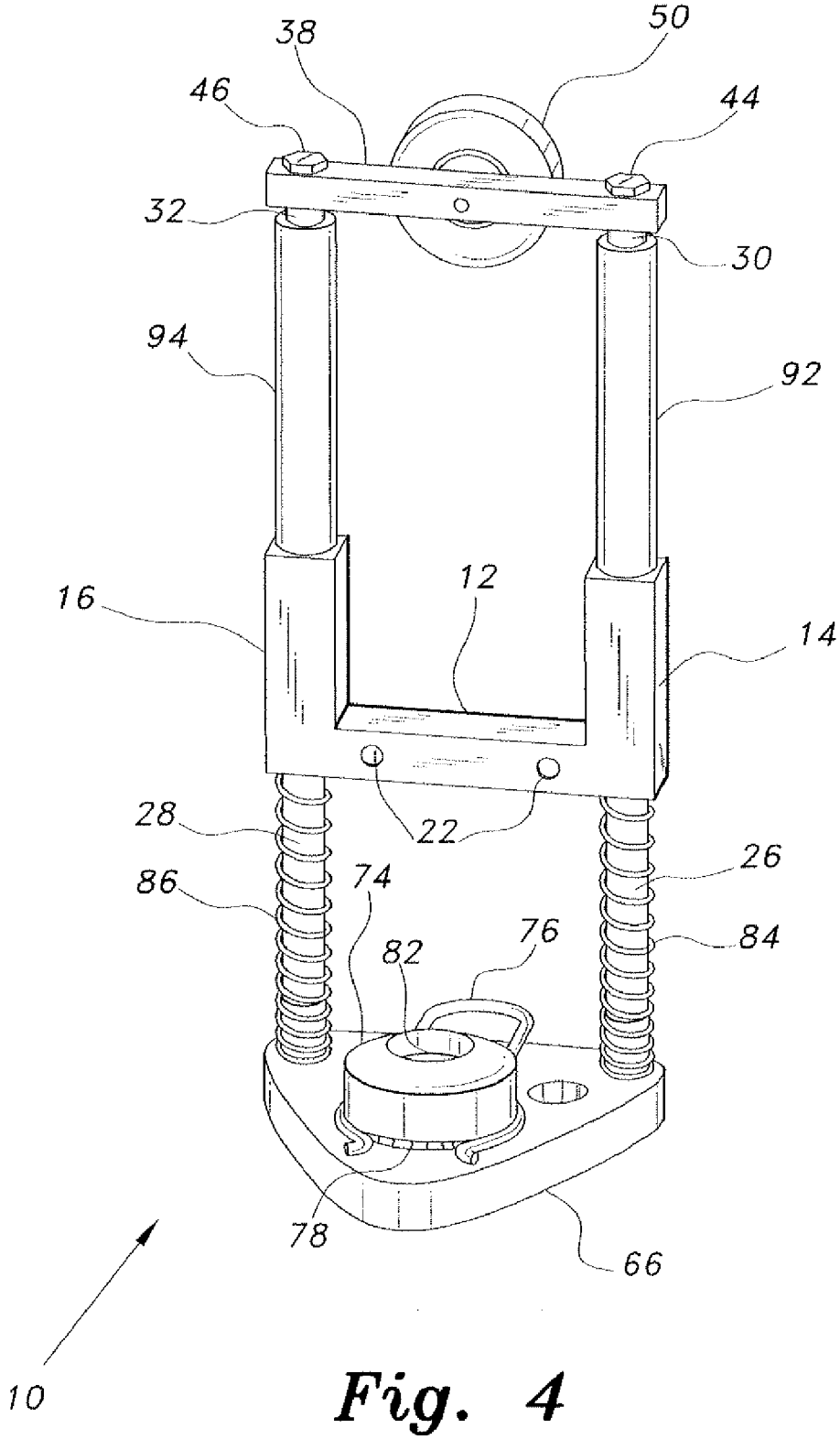
FIG. 4 is a rear perspective view of the centering guide for automated bottling machinery of FIG. 3.

FIG. 2 provides an exploded perspective view of the present centering guide 10, illustrating its various components. FIGS. 3 and 4 provide front and rear perspective views of the assembled centering guide 10. The centering guide 10 includes a central saddle 12 having laterally opposed first and second ends 14 and 16. Each of the ends 14 and 16 has a post hole 18, 20 extending vertically therethrough. The saddle 12 also includes a pair of laterally spaced horizontal bolt holes 22 through the central portion thereof, through which a pair of mounting bolts 24 secure the saddle 12 and the remainder of the mechanism forming the centering guide 10 to the conventional underlying structure of the bottling machinery. An attachment plate A, shown in FIG. 1, is installed over the saddle 12 of the centering guide 10, so that the saddle 12 is captured between the plate A and the conventional underlying structure. The plate A is not a component of the centering guide 10, but is used to secure the guide 10 to the structure of the bottling machinery. Plates A of similar configuration are used to secure the conventional Krones centering guides G to the underlying structure, generally as shown in FIG. 1.

First and second posts 26 and 28 are installed through the respective first and second vertical holes or passages 18 and 20 in the saddle 12. The posts 26 and 28 slide up and down in their respective post holes or passages through the saddle 12 during operation of the device. Each of the posts 26 and 28 has an upper end 30, 32 having an internally threaded bridge attachment hole 34, 36 extending axially into the post 26, 28. A bridge 38, comprising a lateral bar having two opposed post attachment holes 40 and 42 through opposite ends thereof, is installed across the upper ends 30 and 32 of the two posts 26 and 28. Two threaded bolts 44 and 46 attach the bridge 38 to the upper ends 30 and 32 of the two posts 26 and 28. Lock washers (not shown) or other means may be used to prevent the bolts 44 and 46 from unscrewing from their bridge attachment holes 34 and 36 in the two posts 26 and 28.

The bridge 38 has a central axle 48 extending forwardly therefrom. The bridge 38 may include a central passage therethrough, and has an extension that inserts into the passage of the bridge 38. The axle 48 extension may be welded into the passage of the bridge 38, or other means may be used to attach the axle 48 to the bridge 38. The axle 48 includes a relatively larger diameter central portion having a boss or lug extending therefrom that serves as an axle shaft for the cam actuating roller or wheel 50. The axle 48 is shown separate from the bridge 38 in FIG. 2, but it will be understood that the axle 48 is preferably welded to the bridge 38 to provide additional rigidity for the attachment. The axle shaft of the roller attachment axle 48 includes an internally threaded cam roller retaining bolt hole or passage 52 therein. A cam roller retaining bolt 54 is installed through the center of the cam roller 50 and threaded into the shaft of the axle 48. The cam roller 50 assembly includes additional washers, and a lock washer 56 bearing against the outer washer and stationary hub of the roller bearing or ball bearing cam roller 50.

Each of the two lower ends 58 and 60 of the two posts 26 and 28 has a threaded base plate attachment stud 62, 64 extending therefrom. The two studs 62 and 64 are rigidly secured to a base plate 66 by means of two cooperatively threaded, laterally opposed first and second post attachment holes or passages 68 and 70 disposed in the base plate 66. The base plate 66 has a centering bell hole or passage 72 disposed therethrough, the centering bell 74 being removably installed in the passage 72. The centering bell 74 is formed as a unitary plastic component, and is retained in the centering bell passage 72 of the base 66 by a retaining clip 76 that grips a circumferential groove 78 formed around the centering bell 74. The centering bell 74, in turn, has a concentric seal passage 80 disposed therethrough. An elastomeric (rubber, etc.) seal 82 is resiliently retained and removably disposed within the seal passage 80 of the centering bell 74. This structure permits the seal 82 to be easily pressed by hand from the passage 80 in the centering bell 74 without the need for any disassembly of any components of the centering guide 10. Moreover, the centering bell 74 is easily removed merely by pulling its retaining clip 76 from its groove 78, allowing the centering bell 74 to be removed from below from the hole or passage 72 in the base plate 66 without further need for mechanical disassembly of the centering guide 10.

The centering guide 10 operates by cyclically lowering the base plate 66 to place the centering bell 74 and seal 82 over the mouth of a bottle during bottling operations, allowing the bottle to be filled. When the bottle has been filled, the rotation of the bottle filling apparatus and centering guide 10 about the stationary central structure of the bottling machinery causes the cam roller 50 to ascend the slope of a stationary cam (not shown). This lifts the bridge 38 of the centering guide 10, thereby also lifting the rigidly attached posts 26, 28 and the base plate 66, thus lifting the centering bell 74 and its seal 82 from the mouth of the bottle.

The lifting action provided by the cam roller 50 along the stationary cam is a positive action, but without more, the descent of the base plate 66 and its components would be due solely to gravity. However, the centering guide 10 includes first and second lowering springs, respectively 84 and 86, installed over the respective first and second posts 26 and 28 between the base plate 66 and the saddle 12. These springs 84 and 86 are in compression between the stationary saddle 12 and the vertically oscillating base plate 66 to provide a downward spring bias that adds to gravitational force to ensure that the base plate 66, centering bell 74, and its seal 82 will reliably descend to center and seal the mouth of the bottle during the bottle filling operation. First and second spring retaining sleeves or bushings 88 and 90 may be installed about the lower ends 58 and 60 of the two posts 26 and 28 to center the bases of the two springs 84 and 86 about the posts 26 and 28.

First and second spacer sleeves 92 and 94 are installed over the upper portions of the respective first and second posts 26 and 28 between the saddle 12 and the bridge 38. These two sleeves 92 and 94 stop the downward travel of the bridge 38 relative to the vertically stationary saddle 12, thus defining the limit of descent for the base plate 66 as the centering bell 74 and seal 82 are lowered onto the mouth of the bottle. The sleeves 92 and 94 are preferably permanently assembled with the saddle 12 to form a unitary saddle and sleeve assembly at the time of manufacture of the centering guide 10. The sleeves 92, 94 have smaller diameter lower ends that are press fit into the corresponding holes 18 and 20 of the saddle 12. Dowel pins 96 are installed through lateral holes 98 drilled tangentially through the upright ends 14 and 16 of the saddle 12. Before installation of the dowel pins 96 in their holes 98, a drill is passed through the holes 98 to form tangential grooves (shown in broken lines in FIG. 2) in the sides of the smaller diameter lower ends of the sleeves 92 and 94 that reside within the corresponding holes 18 and 20 in the saddle 12. The dowel pins 96 are then installed through their lateral holes 98 in the saddle to lock the two sleeves 92 and 94 to the saddle 12.

Figure 5:
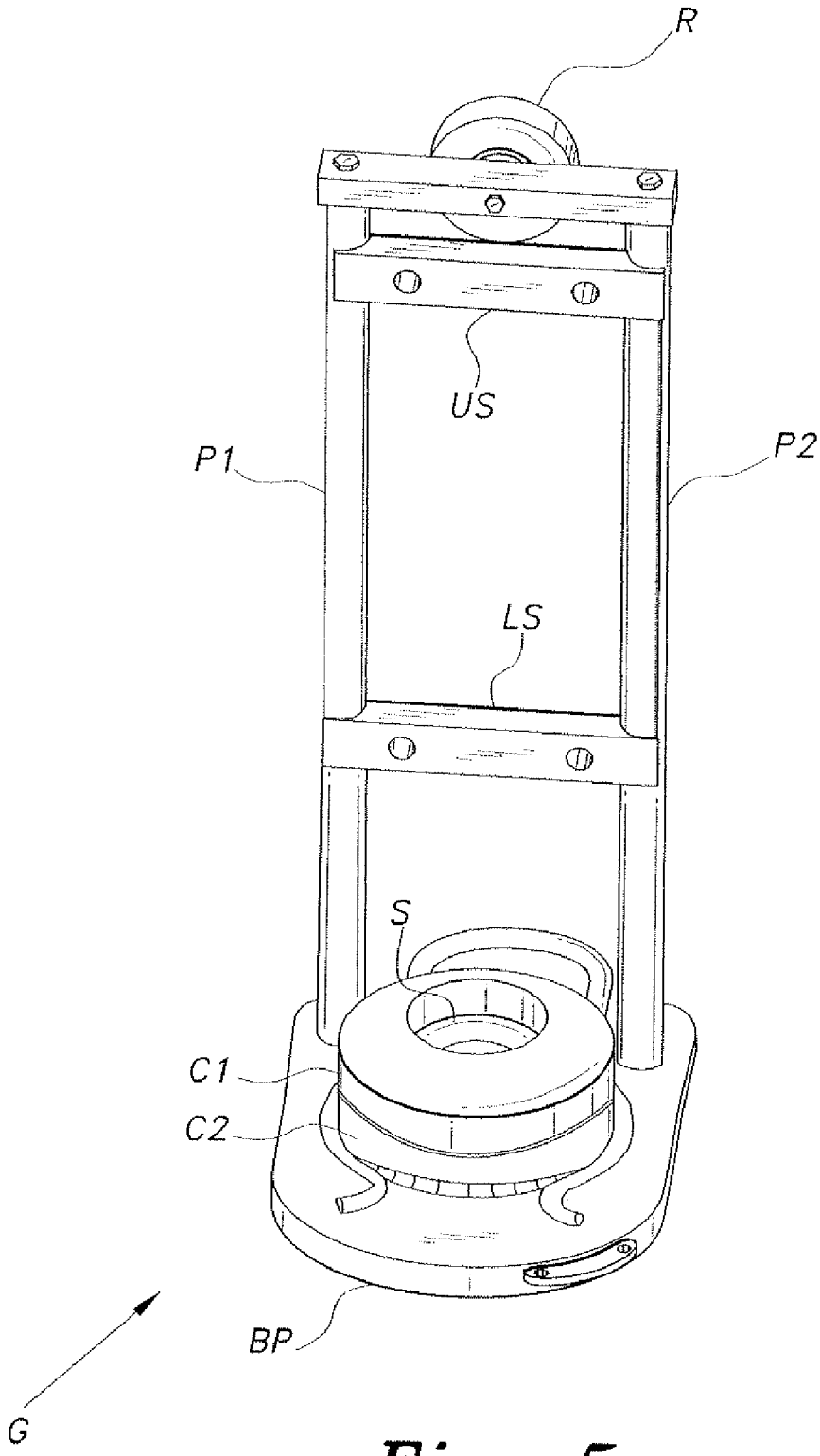
Fig. 5 Prior Art
FIG. 5 is a rear perspective view of a centering guide for automated bottling machinery of the prior art.

Prior art FIG. 5 provides a rear perspective view of a conventional centering guide G provided with the conventional Krones automated bottling machinery, to better illustrate the differences between the conventional centering guide G and the present centering guide 10. The centering bell of the centering guide G is a multiple piece unit comprising components C1 and C2 of metal that must be disassembled in order to remove and replace the seal S therein. This requires the centering bell to be removed from its installation in the base plate BP and transported to a shop or other location with appropriate tools for the disassembly of the centering bell components C1, C2. Moreover, the multipart centering bell C1, C2 is often damaged during this disassembly and reassembly process, thus requiring that it be replaced rather than being reused. Moreover, the two posts P1 and P2 are welded to the base plate BP, rather than being mechanically fastened thereto. These welded components are subject to bending and deformation, requiring that the entire guide G be replaced as the individual components cannot be mechanically removed and replaced from one another.

It will be noted that the centering guide G includes an upper saddle US and a lower saddle LS that attach to the support structure by a total of four fastener bolts F1 through F4, as shown in FIG. 1 of the drawings. Thus, it requires twice the labor to remove the four retaining bolts or fasteners F1 through F4 securing the guide G to the bottling machinery, as it does to remove the two retaining bolts 24 that secure the single saddle 12 of the centering guide 10 and its overlying attachment plate A to the machinery, as is apparent in FIG. 1 of the drawings.

The two saddles US and LS of the prior art are formed of a plastic material with open ends, i.e., vertical slots through which the two posts P1 and P2 travel. This construction provides much more likelihood that the relatively soft plastic will deform and allow the posts P1 and P2 to slip from the respective slots in the ends of either or both of the saddles US and LS, in the centering guide G. In contrast, the single saddle 12 of the present centering guide 10 has laterally closed holes or passages 18 and 20 for the posts 26 and 28, thus assuring that the posts cannot slip laterally from their retention in the saddle.

The saddle 12 of the present centering guide 10 is also preferably formed of corrosion resistant steel, i.e., "stainless" steel, as are the two posts 26 and 28, the bridge 38, and the base plate 66. The use of such materials provides significantly greater durability and reliability, as well as greater sanitation in the bottling industry in which the centering guide 10 is to be used. Other components, e.g., the various fasteners, etc., may also be formed of corrosion resistant steel. The heavier steel components of which the present centering guide 10 is constructed, in comparison to the lighter weight materials used for many of the components of the guide G, provide greater assurance of gravitationally actuated descent of the base plate, bell, and seal to seat over the mouth of a bottle. The springs 84 and 86 of the present centering guide 10 provide further assurance of reliable operation, the two springs providing redundancy in the event that one of the springs breaks.

Another distinction is the retention of the cam roller of the two different guides G and 10. The cam roller 50 of the present centering guide 10 is secured by a threaded bolt 54 installed in a welded axle or boss 48 (FIG. 2). In contrast, the cam roller R of the prior art guide G is retained by a simple cotter key K installed through a diametric passage in the end of an unthreaded axle shaft. The continuous rotation of the cam roller R results in some rotation of the overlying retaining washer so that the washer wears against the relatively thin cotter key K. This eventually leads to the destruction of the cotter key K so that the cam roller R then falls from its axle shaft. Thus, the superior construction of the present centering guide 10, in comparison to the prior art centering guide G, results in a device that requires much less frequent repair, and that is much easier and less expensive to repair when such infrequent repairs may be needed.

It is to be understood that the present invention is not limited to the embodiments described above, but encompasses any and all embodiments within the scope of the following claims.

I claim:

1. A centering guide for automated bottling machinery, comprising:

a saddle having a first end and a second end laterally opposite the first end, each of the ends having a post hole disposed therethrough;

a first post and a second post slidably disposed through the post hole of the respective first end and second end of the saddle, each of the posts having an upper end and a lower end opposite the upper end;

a bridge disposed across the upper ends of the posts;

a cam roller extending from the bridge;

a base plate disposed across the lower ends of the posts, the base plate having a centering bell passage disposed therethrough;

a centering bell removably disposed within the centering bell passage of the base plate, the centering bell being of unitary construction, the centering bell having a retaining clip groove disposed circumferentially therearound and a seal passage extending therethrough;

a centering bell retaining clip removably disposed within the retaining clip groove of the centering bell, the retaining clip securing the centering bell within the centering bell passage of the base plate; and an elastomer seal removably and resiliently disposed within the seal passage of the centering bell.

2. The centering guide for automated bottling machinery according to claim 1, further comprising:

an elongate sleeve disposed upon each of the posts between the saddle and the bridge; and a coil spring disposed concentrically about each of the posts between the saddle and the base plate.

3. The centering guide for automated bottling machinery according to claim 1, wherein:

the lower end of each said post has a threaded base plate attachment stud extending therefrom; and the base plate has threaded, laterally opposed first and second post attachment holes disposed therein, the stud of each said post being threadably attached to the respective post attachment hole of the base plate.

4. The centering guide for automated bottling machinery according to claim 1, wherein the upper end of each said post has a threaded bridge attachment hole disposed therein and the bridge has a first end and a second end opposite the first end, each end of the bridge having a post attachment hole disposed therethrough, the centering guide further comprising a threaded bolt installed through each of the post attachment holes of the bridge and into the bridge attachment hole of the upper end of each said post, thereby securing the bridge across the upper ends of said posts.

5. The centering guide for automated bottling machinery according to claim 1, further comprising:

an axle extending from the bridge normal thereto, the axle having a cam roller retaining bolt hole disposed therein; and a cam roller retaining bolt threadably attached to the bolt hole of the axle, the cam roller retaining bolt securing the cam roller to the axle.

6. The centering guide for automated bottling machinery according to claim 1, wherein the centering bell is plastic.

7. The centering guide for automated bottling machinery according to claim 1 wherein the saddle, each said post, the bridge, and the base plate are formed of corrosion resistant steel.

8. A centering guide for automated bottling machinery, comprising:

a saddle having a first end and a second end laterally opposite the first end, each of the ends having a post hole disposed therethrough;

a first post and a second post slidably disposed through the post hole of the respective first end and second end of the saddle, each of the posts having an upper end and a lower end opposite the upper end;

a bridge disposed across the upper ends of the posts;

a cam roller extending from the bridge;

a base plate disposed across the lower ends of the posts, the base plate having a centering bell passage disposed therethrough;

an elongate spacer sleeve disposed upon each of the posts between the saddle and the bridge;

a coil spring disposed concentrically about each of the posts between the saddle and the base plate;

a centering bell removably disposed within the centering bell passage of the base plate, the centering bell having a seal passage disposed therethrough; and an elastomer seal removably and resiliently disposed within the seal passage of the centering bell.

9. The centering guide for automated bottling machinery according to claim 8, wherein the centering bell is of unitary construction, the centering bell having a retaining clip groove disposed circumferentially therearound; and a centering bell retaining clip removably disposed within the retaining clip groove of the centering bell, the retaining clip securing the centering bell within the centering bell passage of the base plate.

10. The centering guide for automated bottling machinery according to claim 8, wherein:

the lower end of each said post has a threaded base plate attachment stud extending therefrom; and the base plate has threaded, laterally opposed first and second post attachment holes disposed therein, the stud of each said post being threadably attached to the respective post attachment hole of the base plate.

11. The centering guide for automated bottling machinery according to claim 8, wherein the upper end of each said post has a threaded bridge attachment hole disposed therein and the bridge has a first end and a second end opposite the first end, each of the ends of the bridge having a post attachment hole disposed therethrough, the centering guide further comprising a threaded bolt installed through each of the post attachment holes of the bridge and into the bridge attachment hole of the upper end of each said post, thereby securing the bridge across the upper ends of said posts.

12. The centering guide for automated bottling machinery according to claim 8, further comprising:

an axle extending from the bridge noimal thereto, the axle having a cam roller retaining bolt hole disposed therein; and a cam roller retaining bolt threadably attached to the bolt hole of the axle, the cam roller retaining bolt securing the cam roller to the axle.

13. The centering guide for automated bottling machinery according to claim 8, wherein the centering bell is plastic.

14. The centering guide for automated bottling machinery according to claim 8 wherein the saddle, each said post, the bridge, and the base plate are formed of corrosion resistant steel.

15. A centering guide for automated bottling machinery, comprising:

a saddle having a first end and a second end laterally opposite the first end, each of the ends having a post hole disposed therethrough;

a first post and a second post slidably disposed through the post hole of the respective first end and second end of the saddle, each of the posts having an upper end and a lower end opposite the upper end, the lower end of each of the posts having a threaded base plate attachment stud extending therefrom;

a bridge disposed across the upper ends of the posts;

a cam roller extending from the bridge;

a base plate disposed across the lower ends of the posts, the base plate having threaded, laterally opposed first and second post attachment holes and a centering bell passage disposed therethrough, the stud of each of the posts being threadably attached to the respective post attachment hole of the base plate;

a centering bell removably disposed within the centering bell passage of the base plate, the centering bell having a seal passage disposed therethrough; and an elastomer seal removably and resiliently disposed within the seal passage of the centering bell.

16. The centering guide for automated bottling machinery according to claim 15, wherein the centering bell is of unitary construction, the centering bell having a retaining clip groove disposed circumferentially therearound, the centering guide further comprising a centering bell retaining clip removably disposed within the retaining clip groove of the centering bell, the retaining clip securing the centering bell within the centering bell passage of the base plate.

17. The centering guide for automated bottling machinery according to claim 15, further comprising:

an elongate spacer sleeve disposed upon each of the posts between the saddle and the bridge; and a coil spring disposed concentrically about each of the posts between the saddle and the base plate.

18. The centering guide for automated bottling machinery according to claim 15, wherein the upper end of each said post has a threaded bridge attachment hole disposed therein and the bridge has a first end and a second end opposite the first end, each of the ends of the bridge having a post attachment hole disposed therethrough, the centering guide further comprising a threaded bolt installed through each of the post attachment holes of the bridge and into the bridge attachment hole of the upper end of each said post, thereby securing the bridge across the upper ends of said posts.

19. The centering guide for automated bottling machinery according to claim 15, further comprising:

an axle extending from the bridge normal thereto, the axle having a cam roller retaining bolt hole disposed therein; and a cam roller retaining bolt threadably attached to the bolt hole of the axle, the cam roller retaining bolt securing the cam roller to the axle.

20. The centering guide for automated bottling machinery according to claim 15, wherein:

the centering bell is plastic; and the saddle, each said post, the bridge, and the base plate are formed of corrosion resistant steel.

* * * * *